US008069740B2

(12) United States Patent
Saito et al.

(10) Patent No.: US 8,069,740 B2
(45) Date of Patent: Dec. 6, 2011

(54) STARTER MOTOR

(75) Inventors: Shinya Saito, Kiryu (JP); Chihiro Horikoshi, Kiryu (JP); Shigeyuki Enkaku, Kiryu (JP); Hitoshi Ono, Kiryu (JP)

(73) Assignee: Mitsuba Corporation, Gunma (JP)

( * ) Notice: Subject to any disclaimer, the term of this patent is extended or adjusted under 35 U.S.C. 154(b) by 382 days.

(21) Appl. No.: 11/991,263

(22) PCT Filed: Sep. 1, 2006

(86) PCT No.: PCT/JP2006/317308

§ 371 (c)(1),
(2), (4) Date: Mar. 20, 2008

(87) PCT Pub. No.: WO2007/034666

PCT Pub. Date: Mar. 29, 2007

(65) Prior Publication Data

US 2009/0038436 A1 Feb. 12, 2009

(30) Foreign Application Priority Data

Sep. 21, 2005 (JP) ..... 2005-273256

(51) Int. Cl.
*F02N 15/06* (2006.01)

(52) U.S. Cl. ..... 74/6

(58) Field of Classification Search ..... 74/6, 7 E
See application file for complete search history.

(56) References Cited

U.S. PATENT DOCUMENTS 5,265,485 A * 11/1993 Sakamoto et al. ..... 74/7 E
5,884,599 A * 3/1999 Shiozaki et al. ..... 123/192.2
5,920,999 A * 7/1999 Hutter ..... 33/645
6,148,533 A * 11/2000 Hutter ..... 33/645
2002/0069713 A1* 6/2002 Nito et al. ..... 74/7 E
2003/0154808 A1 8/2003 Nito
2006/0219032 A1* 10/2006 Miyake ..... 74/7 E
2008/0257077 A1* 10/2008 Ono et al. ..... 74/6

(Continued)

FOREIGN PATENT DOCUMENTS

JP 44-4042 2/1969

(Continued)

OTHER PUBLICATIONS

International Preliminary Report on Patentability for International Application No. PCT/JP2006/317308. Issued Mar. 26, 2008.

(Continued)

*Primary Examiner* — Vicky Johnson
(74) *Attorney, Agent, or Firm* — Wenderoth, Lind & Ponack, L.L.P.

(57) ABSTRACT

A screw mounting hole and a female screw part are formed in a bearing part of a gear cover, and the screw insertion hole is formed in the idle shaft. The idle shaft is fixed to the gear cover by inserting a fixing screw through the screw mounting hole and screwing it into the female screw part through the screw insertion hole. A positioning groove in a predetermined position in relation to the screw insertion hole is formed in the end face of the idle shaft. When the positioning groove is disposed perpendicularly to an engine mounting surface and the idle shaft is fitted to the gear cover, the screw mounting hole is opposed to the screw insertion hole and, when the fixing screw is fitted, the confirmation of hole positions and the aligning of holes can be eliminated.

12 Claims, 10 Drawing Sheets

U.S. PATENT DOCUMENTS

2009/0133531 A1* 5/2009 Ono et al. ..... 74/7 C

FOREIGN PATENT DOCUMENTS

| | | |
|---|---|---|
| JP | 57-75253 | 5/1982 |
| JP | 58-25857 | 2/1983 |
| JP | 6-59655 | 8/1994 |
| JP | 2003-239834 | 8/2003 |

OTHER PUBLICATIONS

International Search Report issued Oct. 3, 2006 in the International (PCT) Application of which the present application is the U.S. National Stage.

* cited by examiner

[FIG. 1]
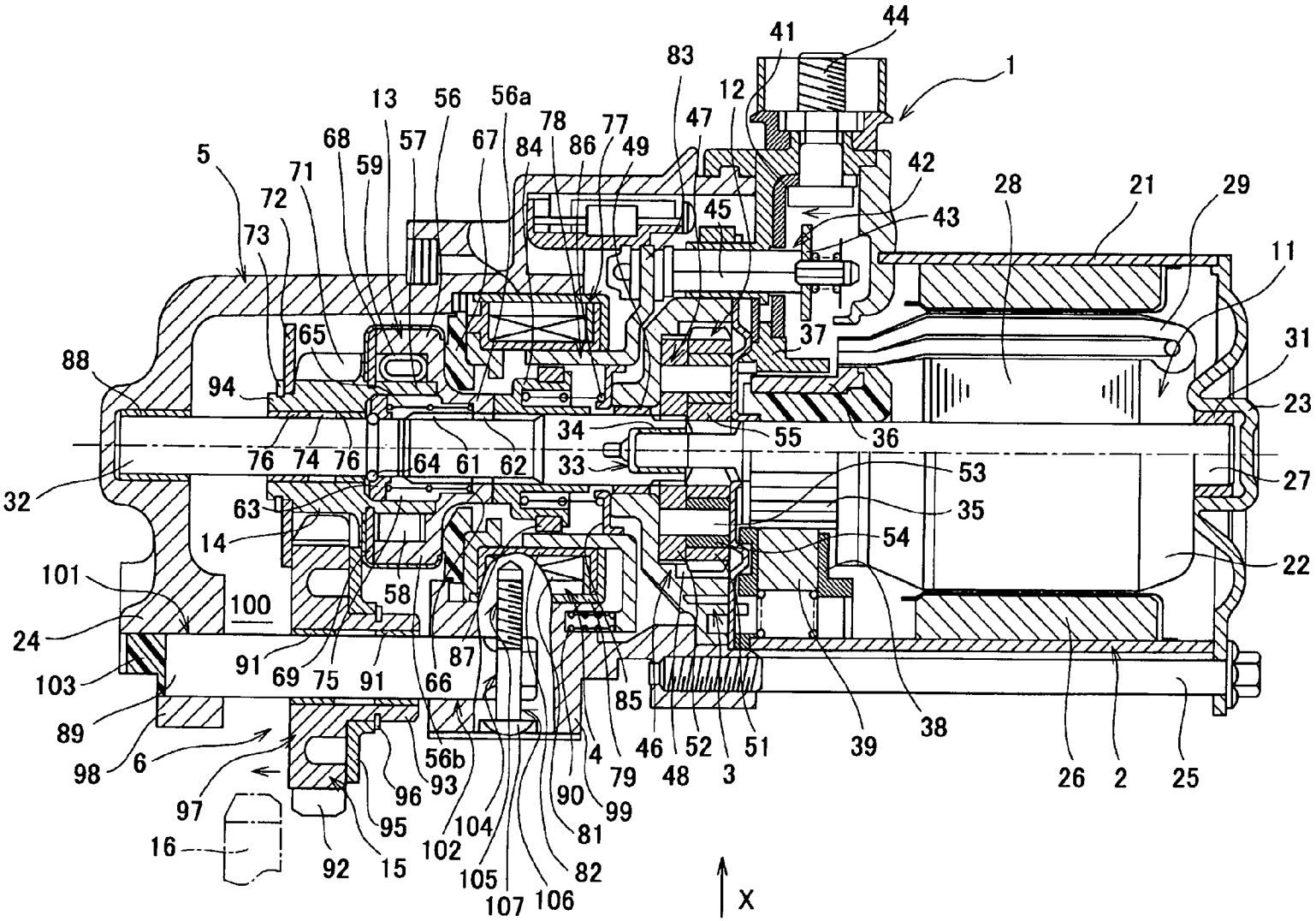

[FIG. 2]
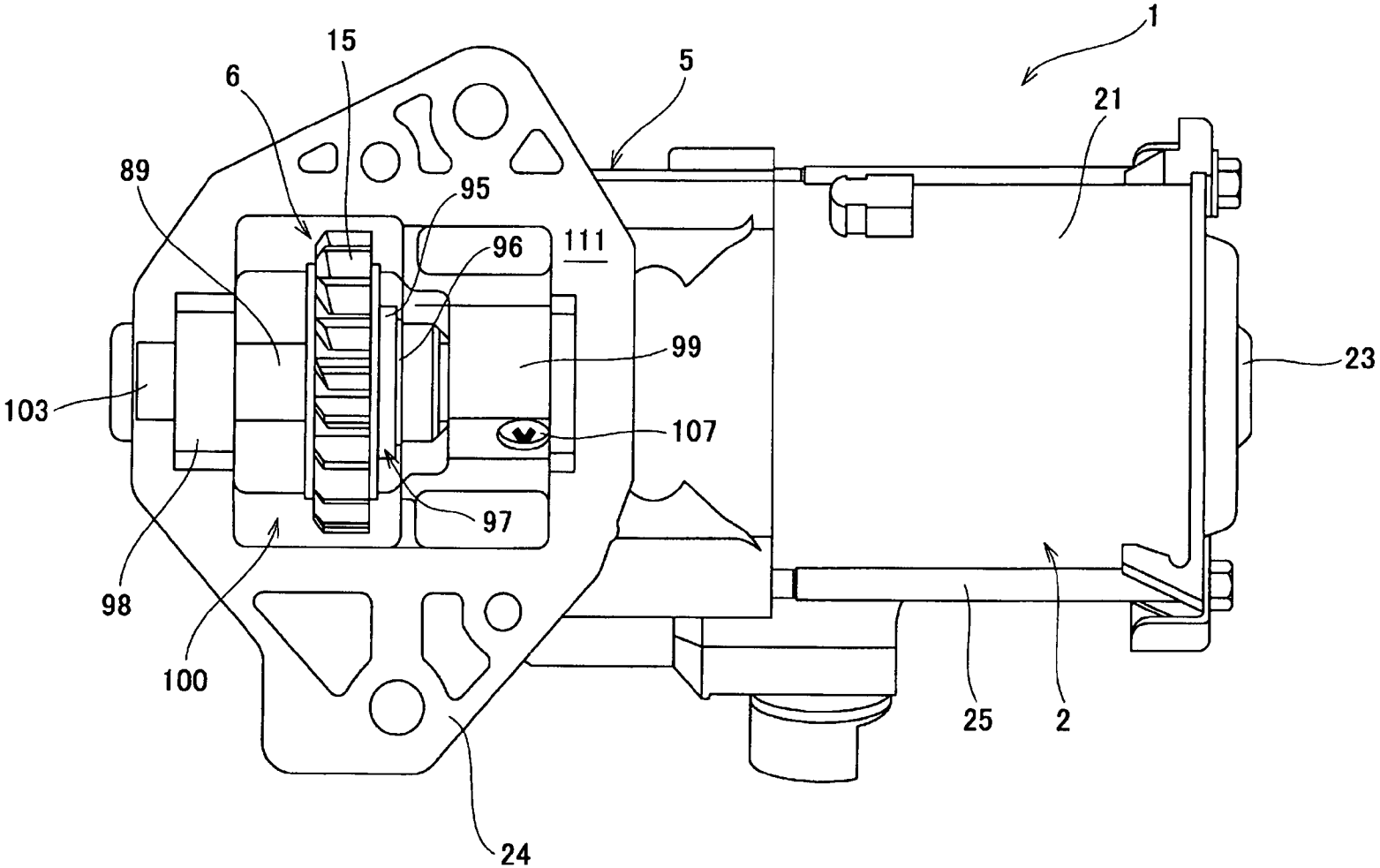

[FIG. 3]
(a)
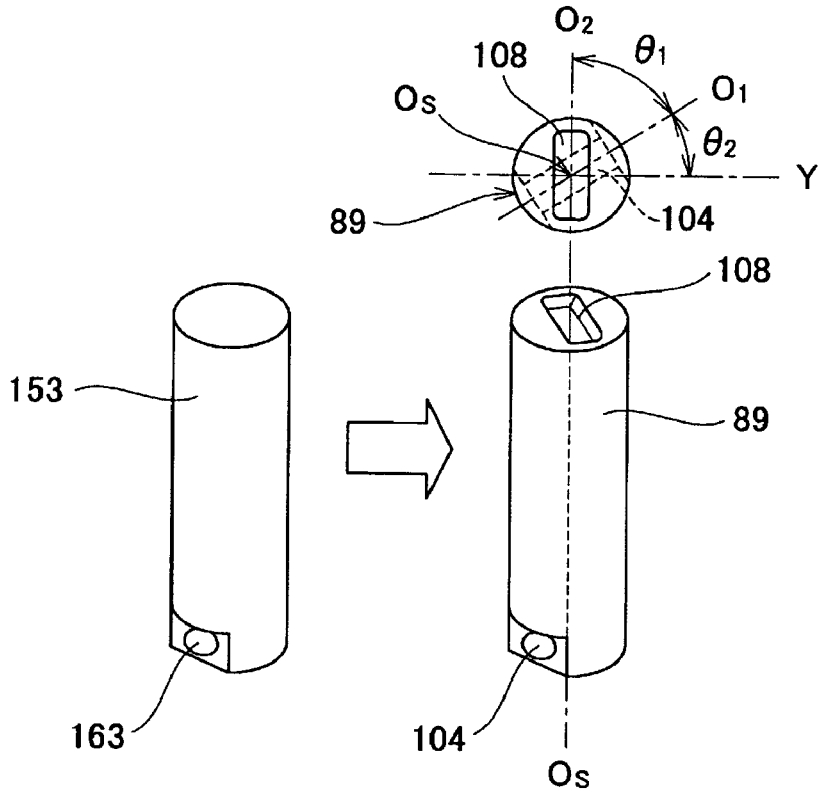
(b)
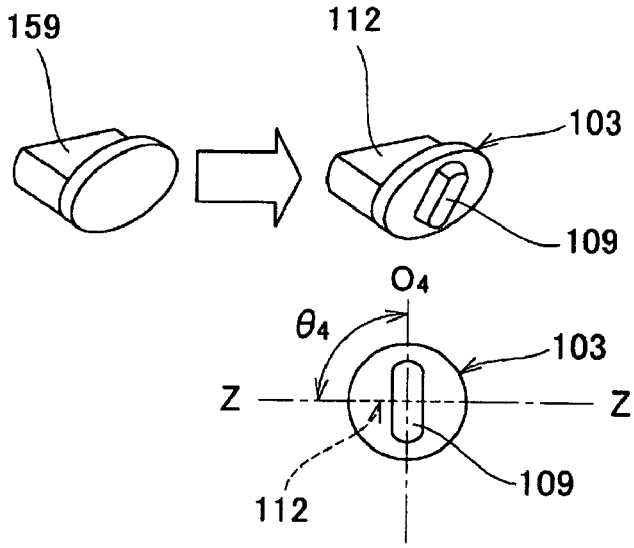

[FIG. 4]
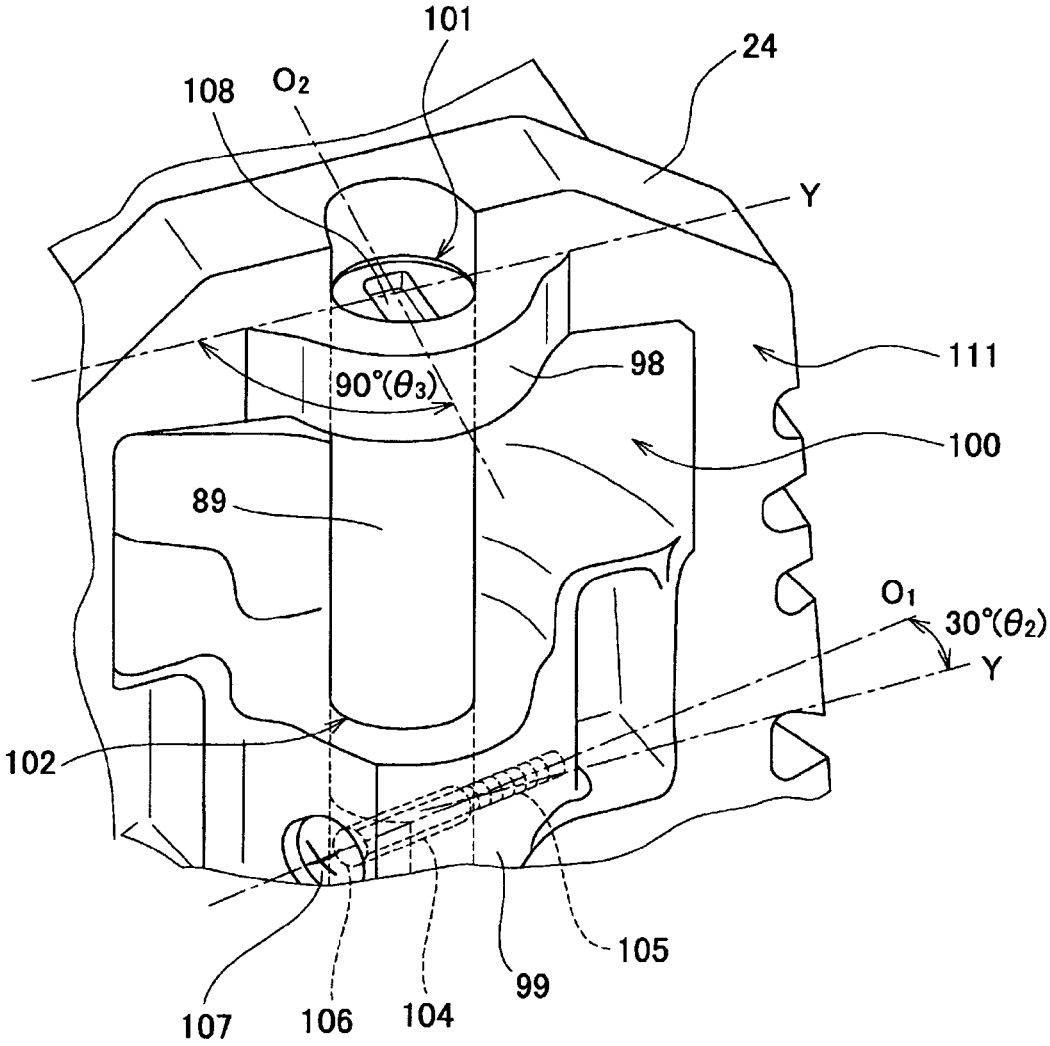

[FIG. 5]
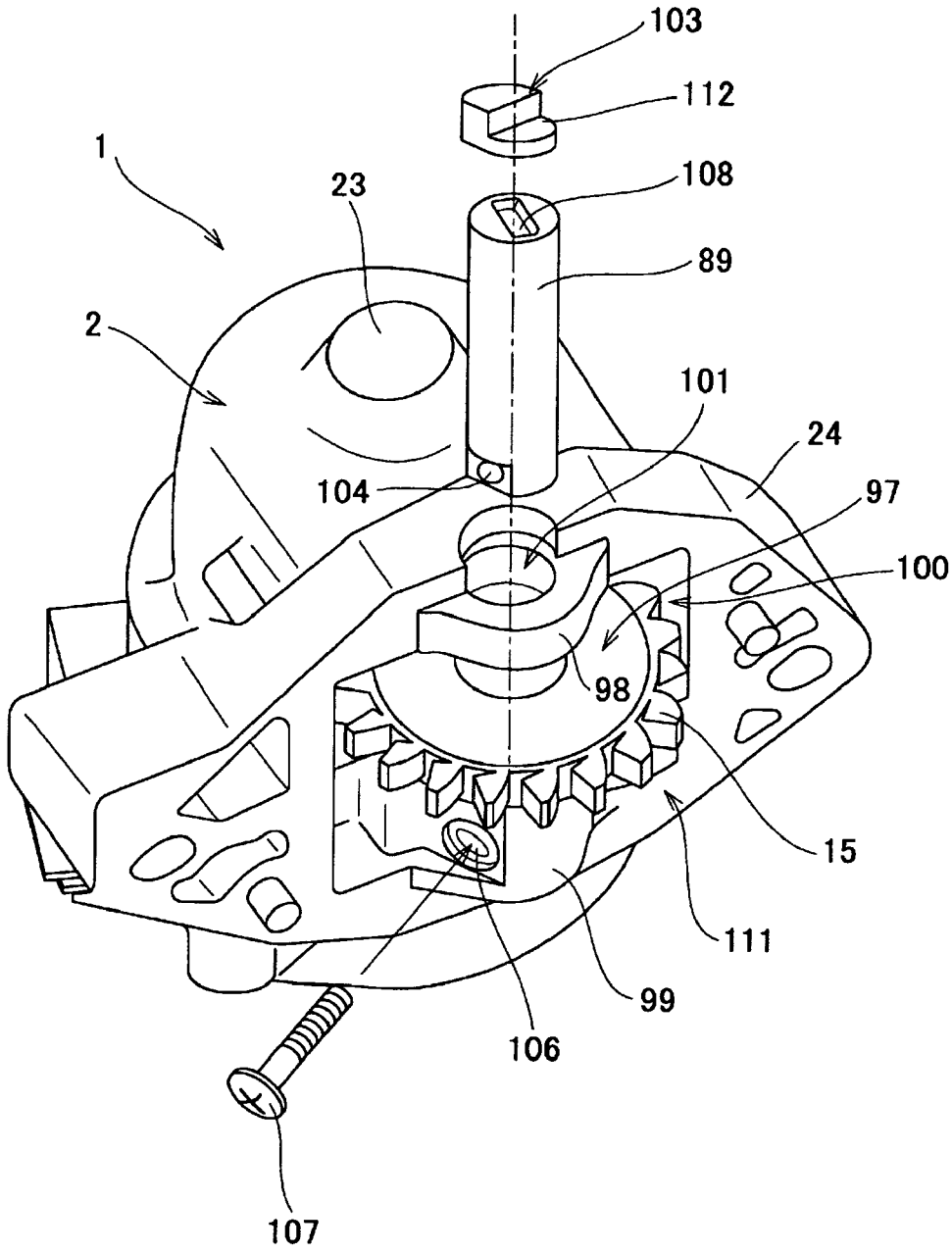

[FIG. 6]
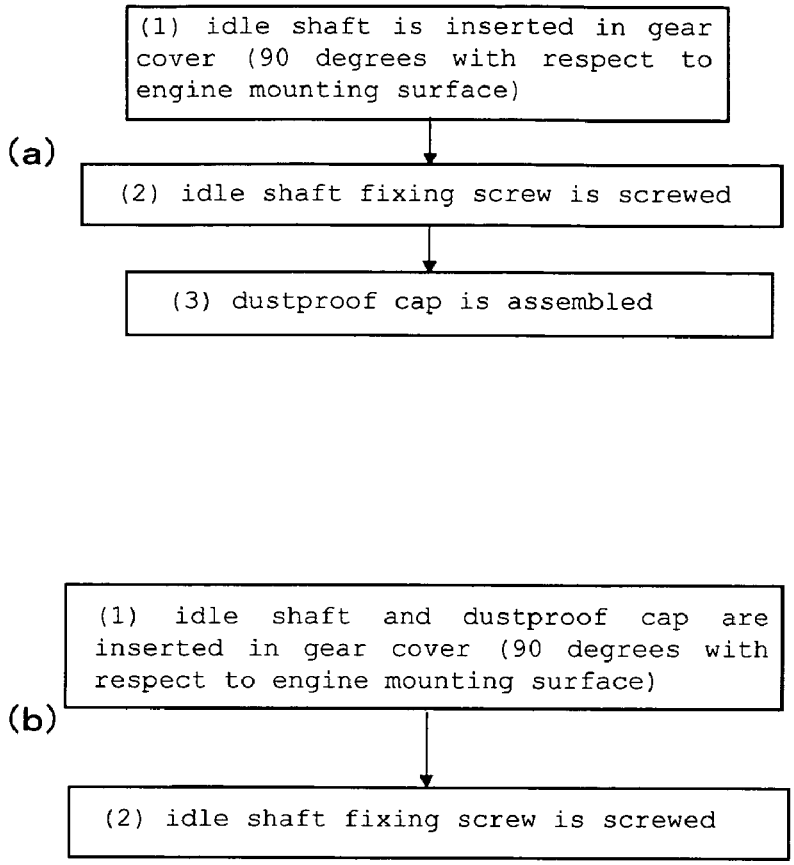

[FIG. 7] PRIOR ART
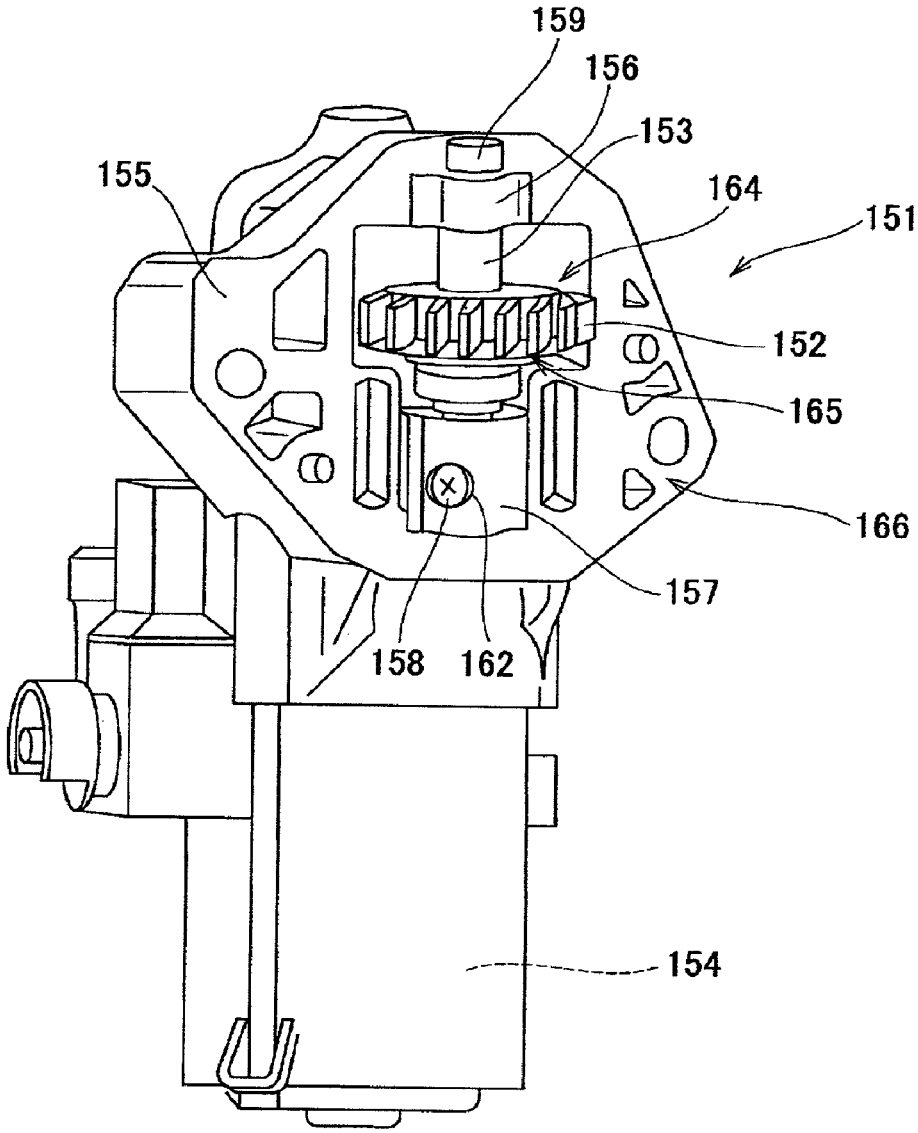

[FIG. 8] PRIOR ART
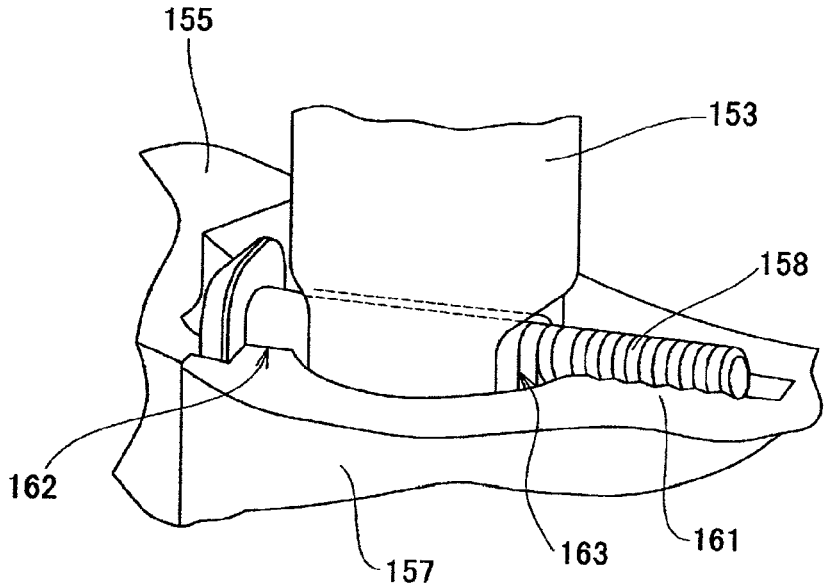
[FIG. 9] PRIOR ART
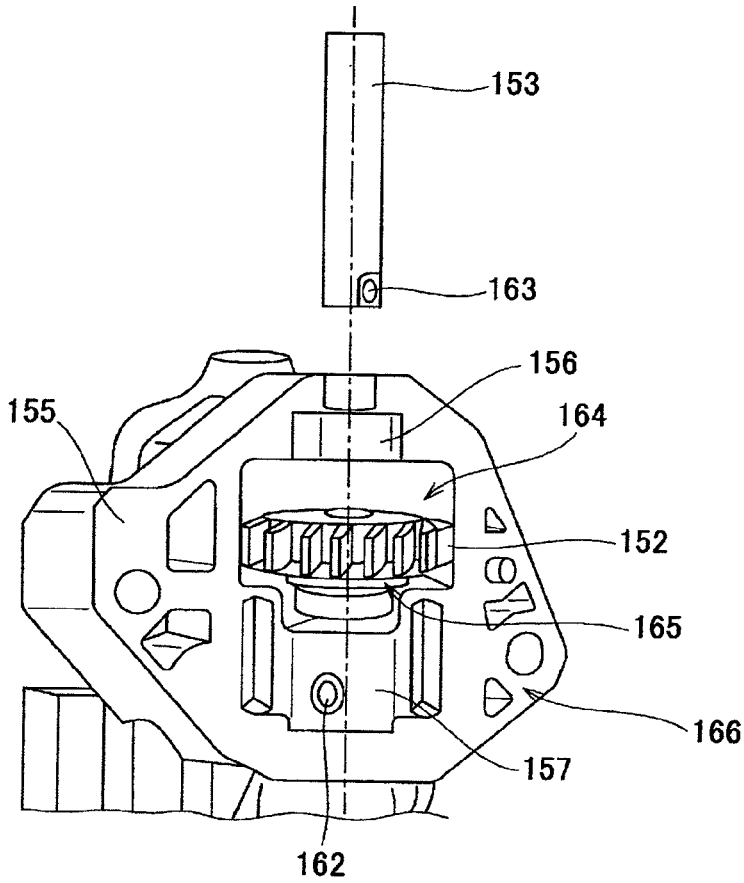

[FIG. 10] PRIOR ART
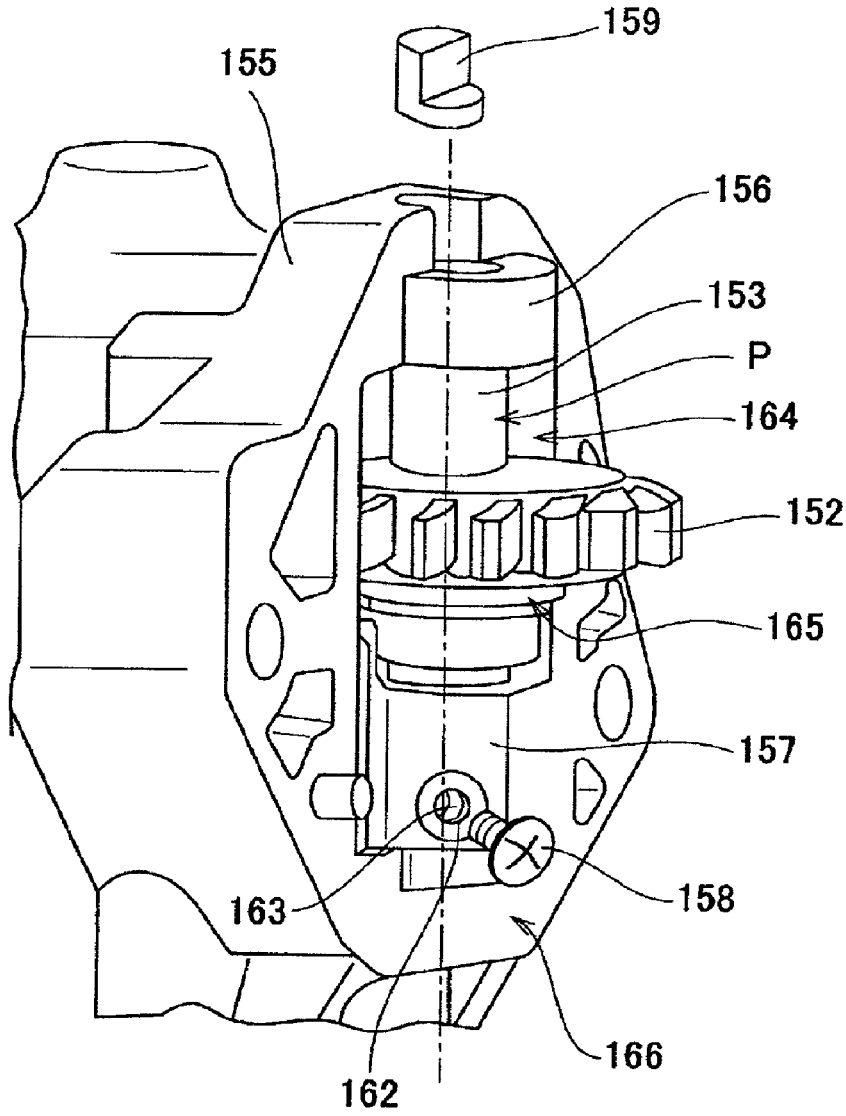

[FIG. 11] PRIOR ART
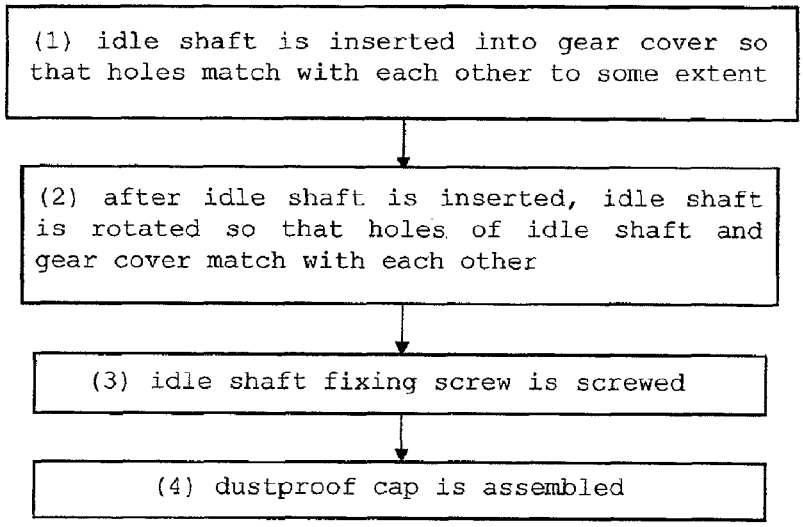

STARTER MOTOR

TECHNICAL FIELD

The present invention relates to a starter motor mounted on an engine of an automobile or the like, and more particularly, to a positioning structure of an idle shaft that supports an idle gear meshing with a ring gear of an engine.

BACKGROUND ART

In engines used in automobiles, two-wheeled motor vehicles, and large generators, a starting operation is generally performed by a starter motor mounted on an engine. FIG. 7 is a perspective view showing an entire configuration of a starter motor 151 described above. The starter motor 151 is mounted on an engine (not shown) at an engine mounting surface 166 on a front side in the figure. The starter motor 151 is provided with an idle gear (middle gear) 152 that is movable in an axial direction and provided in a manner capable of meshing with and being separated from a ring gear (not shown) of the engine. The idle gear 152 is supported by an idle shaft 153 in a manner freely rotatable and movable in the axial direction, and meshes with a pinion (not shown) that is rotationally driven by a motor 154. The pinion is connected to a rotational shaft of the motor 154 via an overrunning clutch.

The idle gear 152 meshes with the ring gear when the engine is started. Along with turning ON of an ignition key switch, the idle gear 152 moves in the axial direction (an upward direction in FIG. 7) from a rest position to mesh with the ring gear, and rotates a crankshaft of the engine. If the engine is started and the number of revolutions of the pinion becomes higher than the number of revolutions of the motor 154, the overrunning clutch achieves an overrunning state, and the idle gear 152 and the pinion are in an idle running state. After the engine is started, the idle gear 152 moves in the axial direction, and is separated from the ring gear. In this manner, meshing between both of the gears is released, and the idle gear 152 returns to the rest position.

On the other hand, in the starter motor 151 described above, the idle shaft 153 is supported by bearing sections 156 and 157 formed on a gear cover 155, and is fixed on the gear cover 155 by an idle shaft fixing screw 158 (hereinafter abbreviated to the fixing screw 158) as shown in FIG. 7. In addition, to a top end section of the idle shaft 153, a dustproof cap 159 made of rubber is attached. FIG. 8 is an explanatory view showing a configuration of a screw fixing section of the idle shaft 153. As shown in FIG. 8, a female screw section 161 and a screw mounting hole 162 are formed on the same axis line on the bearing section 157 of the gear cover 155. A screw insertion hole 163 is formed on the idle shaft 153 corresponding to the female screw section 161 and the screw mounting hole 162. By screwing the fixing screw 158 in the female screw section 161 via the screw insertion hole 163 from the screw mounting hole 162, the idle shaft 153 is fixed on the gear cover 155.

FIGS. 9 and 10 are explanatory views showing processes of assembling and fixing the idle shaft 153 to the gear cover 155. FIG. 11 is a process chart showing a main assembling process in the above case. In the starter motor 151, an idle gear assembly 165 including the idle gear 152 is arranged on an idle gear mounting section 164 of the gear cover 155. In this state, the idle shaft 153 is inserted through an axis hole formed on the bearing section 156 from an upper end side of the gear cover 155 in the figures. At this time, the idle shaft 153 is inserted in the gear cover 155 in a manner such that the screw mounting hole 162 of the gear cover 155 and the screw insertion hole 163 of the idle shaft 153 match with each other to a certain extent (step (1)).

Next, the idle shaft 153 is inserted through the idle gear assembly 165. Thereafter, the idle shaft 153 is inserted in an axis hole formed on the bearing section 157. Then, positions of the screw mounting hole 162 and the screw insertion hole 163 are checked. In case these positions do not match with each other, the idle shaft 153 is rotated so that the holes are matched with each other (step (2)). Thereafter, as shown in FIG. 9, the fixing screw 158 is inserted from the screw mounting hole 162, and then the fixing screw 158 is screwed in the female screw section 161 via the screw insertion hole 163 (step (3)). In this manner, after the idle shaft 153 is fixed on the gear cover 155, the dustproof cap 159 is mounted (step (4)).

Patent Document 1: Jap. Pat. Appln. Laid-Open Publication No. 2003-239834

However, in the starter motor 151 described above, work is carried out after positions of the screw mounting hole 162 and the screw insertion hole 163 are made to match with each other to a certain extent when the idle shaft 153 is inserted. Nevertheless, when the idle shaft 153 is assembled, both of the holes need to be matched with each other for fixing the shaft with a screw. Then, if the positions of the holes do not match with each other to some extent at the time of screwing, the positions of the holes need to be matched again in a state where the idle shaft 153 is inserted. That is, checking of the positions of the holes and alignment of the holes is necessary at the time of fixing the shaft. Therefore, there has been a problem in which workability is not excellent and also additional steps are necessary to thereby increase the manufacturing cost. In particular, in the starter motor 151 in FIG. 7, the screw insertion hole 163 is positioned at 30° from the engine mounting surface 166 in consideration of interference with other sections. Therefore, alignment is difficult in comparison with a case in which the holes are at positions, such as positions in the right angle, where a reference can be easily set, and improvement in this respect has been required.

In addition, the alignment of holes described above is carried out in a manner such that a P part in FIG. 10 is held to rotate the idle shaft 153 while looking through the screw mounting hole 162 in order to match the screw insertion hole 163 with the screw mounting hole 162. With respect to this point, after the idle shaft 153 is inserted, a width of the P part is narrow and the idle shaft 153 is difficult to rotate, and also a part between the idle gear 152 and the idle shaft 153 is a grease application section which is not preferably touched by a worker for quality reasons. Further, a hand of the worker is stained at the time of alignment, which is not preferable in view of a working environment. In addition, in case the insertion and the screwing of the idle shaft 153 are carried out in an automated line, a step of detecting whether the holes match with each other or not is difficult to be set, and has been an obstacle to automation of assembly of the starter motor 151.

An object of the present invention is to provide a starter motor enabling screwing of an idle shaft to be fixed on a gear cover in a manner such that holes can be aligned easily and accurately when an idle shaft is mounted and such alignment is not carried out again.

SUMMARY OF THE INVENTION

A starter motor of the present invention includes an idle gear that meshes with a ring gear of an engine in a manner rotationally driven by a motor and moving in an axial direction, an idle shaft that supports the idle gear in a manner such that the idle gear can be rotated freely and moved in the axial direction, a covering member that is mounted to the engine and supports both end parts of the idle shaft, and a shaft fixing member that is inserted from a mounting hole formed on the covering member to an insertion hole provided on the idle shaft. The idle shaft is provided with a positioning part that is arranged at a predetermined position to make the mounting hole and the insertion hole face each other in a state in which the shaft fixing member can be inserted.

In the present invention, the positioning part is provided on the idle shaft, and is arranged at the predetermined position. In this manner, the idle shaft can be mounted in a state in which the mounting hole on a covering member side and the insertion hole on an idle shaft side face each other. Accordingly, positioning of the mounting hole and the insertion hole can be carried out easily and accurately at the time of mounting the idle shaft. For this reason, the shaft fixing member can be mounted without checking whether the mounting hole and the insertion hole match with each other or not, and checking of positions of the holes and alignment of the holes are not necessary at the time of mounting the shaft fixing member. In addition, work for adjusting the positions of the holes by holding the idle shaft can also be eliminated.

In the above starter motor, the positioning part may be provided on an end surface of the idle shaft under a predetermined positional relationship with the insertion hole. In addition, the mounting hole and the insertion hole may be made facing each other by arranging the positioning part under a predetermined positional relationship with respect to an engine mounting surface of the gear cover. In this case, the mounting hole and the insertion hole may be made facing each other by arranging the positioning part at a position in the right angle with respect to the engine mounting surface of the gear cover. Alternatively, the mounting hole and the insertion hole may be made facing each other by allocating the positioning part at a position in parallel with the engine mounting surface of the gear cover. Further, a groove or a protrusion extending in a radial direction may be formed on the end surface of the idle shaft as the positioning part, and the groove or the protrusion may be provided at a position rotated from a position of the insertion hole for a predetermined angle in a circumferential direction with a center axis line of the idle shaft being a center.

In the above starter motor, a covering member mounted on one end side of the idle shaft may also be provided, and a junction section that is connected to the positioning part in a predetermined positional relationship may be provided on the covering member. In addition, when the covering member is mounted on the positioning part through the junction section, a positioning surface that is flush with the engine mounting surface of the gear cover may be provided on the covering member, and in this manner, the covering member can be used to align the mounting hole and the insertion hole. In this case, when the positioning surface is provided in a manner flush with the engine mounting surface, the mounting hole and the insertion hole may be made facing each other.

ADVANTAGES OF THE INVENTION

The starter motor of the present invention includes an idle gear that meshes with a ring gear of the engine and is supported by an idle shaft in a manner such that the idle gear is freely rotatable and movable in the axial direction, a covering member that supports both end parts of the idle shaft, and a shaft fixing member that is inserted from a mounting hole formed on the covering member to an insertion hole provided on the idle shaft. According to the starter motor of the present invention, the positioning part that is allocated in a predetermined position to make the mounting hole and the insertion hole face each other in a state in which the shaft fixing member can be inserted is provided on the idle shaft, therefore the mounting hole and the insertion hole can be aligned when the idle shaft is mounted. For this reason, in steps thereafter, checking of the positions of the holes and alignment of the holes become unnecessary, and workability in an assembly step is improved and also reduction in the number of steps can be attempted. In addition, work of adjusting the positions of the holes by holding the idle shaft becomes unnecessary, and a worker never touches the grease application section. In this manner, quality of a product is improved, and hands of the worker are not stained as well as the working environment can be improved.

BRIEF DESCRIPTION OF THE DRAWINGS

FIG. 1 is a cross-sectional view showing a configuration of a starter motor adopting an idle shaft positioning structure of the present invention;

FIG. 2 is a bottom view (viewed from an angle X in FIG. 1) of the starter motor of FIG. 1;

FIG. 3 is an explanatory view showing shapes of an idle shaft and a dustproof cap of the starter motor of FIG. 1 in comparison with conventional shapes, where (a) and (b) indicate configurations of the idle shaft and the dustproof cap, respectively;

FIG. 4 is an explanatory view showing a state in which the idle shaft is mounted on a gear cover;

FIG. 5 is an explanatory view showing a step of assembling and fixing the idle shaft in the gear cover;

FIG. 6 is a process chart showing a main assembly step if the idle shaft is assembled and fixed in the gear cover;

FIG. 7 is a perspective view showing an entire configuration of a conventional starter motor;

FIG. 8 is an explanatory view showing a configuration of a screw fixing section of an idle shaft in the starter motor in FIG. 7;

FIG. 9 is an explanatory view showing a conventional step of assembling and fixing the idle shaft in the gear cover;

FIG. 10 is an explanatory view showing a conventional step of assembling and fixing the idle shaft in the gear cover; and FIG. 11 is a process chart showing a main assembly step in case the idle shaft is assembled and fixed in the gear cover in the conventional starter motor.

DETAILED DESCRIPTION OF THE INVENTION

Now, the present invention will be described in greater detail by referring to the accompanying drawings. FIG. 1 is a cross-sectional view showing a configuration of a starter motor adopting an idle shaft positioning structure of the present invention, FIG. 2 is a bottom view (viewed from an angle X in FIG. 1) of the starter motor of FIG. 1. The electric starter motor 1 of FIG. 1 is used for starting an automotive engine, giving rotations to a resting engine required for intake, atomization, compression and ignition of fuel.

Roughly speaking, the electric starter motor 1 comprises a motor section 2, a gear section 3, a magnet switch section 4, a case section 5 and an idle section 6. In the motor section 2, there is provided a motor (electric motor) 11 as a driving source, and in the gear section 3, there are provided a planetary gear mechanism 12, an overrunning clutch 13 and a pinion 14 as reduction gears. In the idle section 6, there is provided an idle gear 15 engaging with the pinion 14. The idle gear 15 is mounted so as to be movable axially (in the left and right directions in the figure), and when moving in the left direction in the figure, the idle gear 15 engages with a ring gear 16 of the engine. The torque of the motor 11 is transmitted to the pinion 14 via the planetary gear mechanism 12 and the overrunning clutch 14, and then, from the idle gear 15 to the ring gear 16, starting the engine.

The motor 11 is configured to arrange an armature 22 rotatably within a cylindrical motor housing 21. The motor housing 21 acts also as the yoke of the motor 11 and is made of a magnetic metal such as iron. A metallic end cover 23 is mounted to the right end section of the motor housing 21. On the other hand, a gear cover (cover member) 24 of the case section 5 is mounted to the left end section of the motor housing 21. The end cover 23 is secured to the gear cover 24 by a set bolt 25, and the motor housing 21 is secured between the end cover 23 and the gear cover 24.

A plurality of permanent magnets 26 are secured to the inner circumferential surface of the motor housing 21 in a circumferential direction, and an armature 22 is provided inside each of the permanent magnets 26. The armature 22 is composed of an armature core 28 secured to a motor shaft 27 and an armature coil 29 wound on the armature core 28. The right end section of the motor shaft 27 is supported rotatably by a metal bearing 31 mounted on the end cover 23. On the other hand, the left end section of the motor shaft 27 is supported rotatably by an end section of a drive shaft (output shaft) 32 to which the pinion 14 is mounted. In the right end section of the drive shaft 32 a bearing section 33 is provided concavely, and the motor shaft 27 is supported rotatably by a metal bearing 34 mounted to the bearing section 33.

On one end side of the armature core 28, there is arranged adjacently a commutator 35 secured to the motor shaft 27 with being fitted thereon. A plurality of commutator pieces 36 made of a conductive material are fitted to the outer circumferential surface of the commutator 35, and the end section of the armature coil 29 is secured to each of the commutator pieces 36. A brush holder 37 is mounted to the left end section of the motor housing 21. Four brush holding sections 38 are arranged in the brush holder 37 with being spaced in a circumferential direction. A brush 39 is contained in each brush holding section 38 so as to be able to appear freely. The projecting distal end (inner diameter side distal end) of the brush 39 is in sliding contact with the outer circumferential surface of the commutator 35.

To the rear end side of the brush 39, there is mounted a pig tail (not shown), which is connected electrically to a conductive plate 41 of the brush holder 37. A switch section 42 is provided on the conductive plate 41, and when a switch plate 43 comes into contact with the conductive plate 41, an electric connection is made between a power source terminal 44 and the brushes 39, supplying electric power to the commutator 35. The switch plate 43 is mounted to a switch shaft 45, and when the magnet switch section 4 turns on electricity, the switch shaft 45 moves to the left to bring the switch plate 43 into contact with the conductive plate 41.

In the planetary gear mechanism 12 of the gear section 3, there are provided an internal gear unit 46 and a drive plate unit 47. The internal gear unit 46 is secured to the right end side of the gear cover 24, and on the inner circumferential side thereof, an internal gear 48 is formed. A metal bearing 49 is contained in the center of the internal gear unit 46, supporting the right end side of the drive shaft 32 rotatably. The drive plate unit 47 is secured to the right end side of the drive shaft 32, and three planetary gears 51 are mounted with being equally spaced. The planetary gears 51 are supported rotatably by a support pin 53 secured to a base plate 52 via a metal bearing 54. The planetary gears 51 engage with the internal gear 48.

In the left end side of the motor shaft 27, a sun gear 55 is formed. The sun gear 55 engages with the planetary gears 51, and the planetary gears 51 rotate and revolve between the sun gear 55 and the internal gear 48. When the motor 11 is operated, the sun gear 55 rotates together with the motor shaft 27, and the rotations of the sun gear 55 are accompanied by the revolutions of the planetary gears 51 around the sun gear 55 with the planetary gears 51 engaging with the internal gear 48. Thereby, the base plate 52 secured to the drive shaft 32 is rotated, transmitting the decelerated rotations of the motor shaft 27 to the drive shaft 32.

The overrunning clutch 13 transmits the rotations decelerated by the planetary gear mechanism 12 to the pinion 14 in one rotation direction. The overrunning clutch 13 is configured to arrange a roller 58 and a clutch spring 59 between a clutch outer 56 and a clutch inner 57. The clutch outer 56 comprises a boss section **56*a* and a clutch section 56*b*, and the boss section 56*a* is mounted to a helical spline section 61 of the drive shaft 32. On the inner circumferential side of the boss section 56*a*, there is formed a spline section 62 engaging with the helical spline section 61. Thereby, the clutch outer 56 is made movable axially on the drive shaft 32 along the helical spline section 61**.

A stopper 63 is mounted to the drive shaft 32. The stopper 63 is hindered from moving axially by a circlip 64 fitted to the drive shaft 32. One end side of a gear return spring 65 is attached to the stopper 63. The other end side of the gear return spring 65 is in contact with the inner end wall 66 of the boss section **56*a*. The clutch outer 56 is pushed to the right by this gear return spring 65, and at normal times (at the time of no power distribution), the clutch outer 56 is held while being in contact with a clutch stopper 67 secured to the gear cover 24**.

On the inner circumference of the clutch section **56*b* of the clutch outer 56, there is provided a clutch inner 57 formed integrally with the pinion 14. A plurality of pairs of rollers 58 and clutch springs 59 are arranged between the clutch outer 56 and clutch inner 57. In addition, on the outer circumference of the clutch section 56*b*, a clutch cover 68 is provided, and a clutch washer 69 is fitted between the left end surface of the clutch section 56*b* and the clutch cover 68. By this clutch washer 69, the roller 58 and the clutch spring 59 are contained on the inner circumferential side of the clutch section 56*b*** with being hindered to move axially.

The inner circumferential wall of the clutch section **56*b* is formed as a cam surface including a cuneiform slope section and a curved section. The roller 58 is usually pushed by the clutch spring 59 toward the curved section side. When the clutch outer 56 rotates and the roller 58 is interposed between the cuneiform slope section and the outer circumferential surface of the clutch inner 57 against the pushing force of the clutch spring 59, the clutch inner 57 rotates together with the clutch outer 56 via the roller 58. Thereby, when the motor 11 is operated and the drive shaft 32 rotates, the rotations thereof are transmitted from the clutch outer 56 via the roller 58 to the clutch inner 57, rotating the pinion 14**.

On the contrary, when the engine is started and the clutch inner 57 rotates faster than the clutch outer 56, the roller 58 moves to the curved section side, bringing the clutch inner 57 into an idle running state to the clutch outer 56. That is, when the clutch inner 57 comes into an overrunning state, the roller 58 is not interposed between the cuneiform slope section and the outer circumferential surface of the clutch inner 57 and the rotations of the clutch inner 57 are not transmitted to the clutch outer 56. Accordingly, even if the clutch inner 57 is rotated faster from the engine side after the engine start, the rotations thereof are interrupted by the overrunning clutch 13 and are not transmitted to the motor 11 side.

The pinion 14 is a steel member formed by cold forging and meshes with the idle gear 15. The pinion 14 is formed integrally with the clutch inner 57, and a gear section 71 and a boss section 94 are formed on the left side of the clutch inner 57. An outer diameter of the boss section 94 is smaller than a root outer diameter of the gear section 71, and the pinion 14 can be easily cold-forged. By cold-forging the pinion 14, accuracy of a dimension in an axial direction of the gear section 71 is improved. Thereby, a gap between parts, such as between the pinion 14 and the idle gear 15, can be made smaller, and wearing away and breakage of the parts can be prevented. In addition, by forming the gear section 71 by cold forging, work hardening is generated and strength of the gear section 71 is increased, and thereby strength of a gear connecting section can be increased.

A pinion washer 72 made of steel is mounted on the boss section 94. The pinion washer 72 is fixed by the C-ring 73 mounted on the boss section 94 in a manner such that disconnection is prevented in the axial direction. An outer circumferential section of the pinion washer 72 contacts with a left side surface of the idle gear 15. In this manner, when the pinion 14 moves to a rightward direction, the idle gear 15 also moves to the rightward direction, and the idle gear 15 is separated from the ring gear 16 after the engine is started.

On the inner circumferential side of the pinion 14, there are formed a shaft hole 74 and a spring holding section 75. In the shaft hole 74, a pinion gear metal 76 is fitted, and the pinion 14 is supported rotatably by the drive shaft 32 via the pinion gear metal 76. The spring holding section 75 is formed on the inner circumferential side of the clutch inner 57, and the stopper 63 and the gear return spring 65 are held therein.

The magnet switch section 4 is arranged concentrically with the motor 11 and the planetary gear mechanism 12 on the left side of the planetary gear mechanism 12. The magnet switch section 4 comprises a steel secured section 77 secured to the gear cover 24 and a movable section 78 arranged movably in the left and right directions along the drive shaft 32. In the secured section 77, there are provided a case 79 secured to the gear cover 24, a coil 81 held in a case 79 and a stationary iron core 82 mounted to the inner circumferential side of the case 79. In the movable section 78, there is provided a movable iron core 83 to which the switch shaft 45 is mounted, and on the inner circumferential side of the movable iron core 83, a gear plunger 84 is mounted. On the outer circumferential side (lower end side in the figure) of the movable iron core 83, a switch return spring 90 is fitted. The other end side of the switch return spring 90 is in contact with the gear cover 24, and the movable iron core 83 is pushed to the right.

To the inner circumference of the movable iron core 83, a bracket plate 85 is secured further. One end of a plunger spring 86 is secured to the bracket plate 85 by caulking. When the ignition key switch is turned OFF (in the state of FIG. 1), the other end of the plunger spring 86 contacts with a gear plunger 84, and the gear plunger 84 is pushed by the plunger spring 86 to the left. The gear plunger 84 is mounted axially movably to the drive shaft 32, and a slide bearing 87 is provided between the gear plunger 84 and the inner circumferential surface of the movable iron core 83.

The case section 5 is provided with the aluminum die-cast gear cover 24, and the left end side of the drive shaft 32 is supported rotatably by the gear cover 24 via a metal bearing 88. To the gear cover 24, there is further mounted an idle shaft 89 supporting the idle gear 15. The left end side of the idle shaft 89 is retained by an idle shaft stopper (not shown). Within the gear cover 24, as described above, the synthetic resin (for example, glass-fiber-reinforced polyamide) clutch stopper 67 and the case 79 are secured, and to the right end side thereof, the motor housing 21 and the end cover 23 are secured by the set bolt 25.

The idle section 6 is provided with the idle gear 15. The gear cover 24 is provided with an idle gear mounting section 100, and the idle gear 15 is arranged in the idle gear mounting section 100 in a state where the idle gear 15 is supported by the idle shaft 89. The idle gear 15 is provided with a gear section 92 and a boss section 93, and the gear section 92 meshes with the gear section 71 of the pinion 14. A collar 95 made of synthetic resin (for example, glass fiber reinforced polyamide) is fitted on the boss section 93. The collar 95 includes a flange section **95*a* and a boss section 95*b*, and an outer circumference section of the flange section 95*a* is interposed between an end surface of the idle gear 15 and the clutch cover 68. Grease is applied as lubricant between the collar 95 and the clutch cover 68 and between the collar 95 and the idle gear 15 for improving a sliding property. An end part of the boss section 95*b* contacts with a C-ring 96 attached to the boss section 93. The collar 95 is fixed by the C-ring 96 in a manner such that disconnection is prevented in the axial direction, and forms an idle gear assembly 97 together with the idle gear 15**.

The idle gear 15 is supported by the idle shaft 89 in a manner freely rotatable through a metal bearing 91. The idle shaft 89 is supported by the bearing sections 98 and 99 provided on the gear cover 24. An axis opening 101 and an axis hole 102 are formed on the bearing sections 98 and 99. The idle shaft 89 is inserted through the axis opening 101 in a state in which the idle gear 15 is supported and further inserted into the axis hole 102. An end part of the idle shaft 89 on a bearing section 98 side is attached with a dustproof cap (covering member) 103 made of rubber. An end part of the idle shaft 89 on a bearing section 99 side is formed with a screw insertion hole 104. The bearing section 99 is formed with a female screw section 105 and a screw mounting hole 106 on the same axis line similar to FIG. 8. By screwing an idle shaft fixing screw 107 (an idle shaft fixing member, hereinafter abbreviated to the fixing screw 107) from the screw mounting hole 106 to the female screw section 105 through the screw insertion hole 104, the idle shaft 89 is fixed on the gear cover 24.

On an end surface (left end surface in the figure) on a bearing section 98 side of the idle shaft 89, a positioning groove (positioning part) 108 is recessed for alignment between the screw mounting hole 106 and the screw insertion hole 104. In addition, in the dustproof cap 103, a fitting protrusion 109 (junction part) is provided in a projecting manner in accordance with the positioning groove 108. FIG. 3 is an explanatory view showing shapes of the idle shaft 89 and the dustproof cap 103 in comparison with conventional shapes, and (a) indicates a configuration of the idle shaft 89 and (b) indicates a configuration of the dustproof cap 103. A left side in FIG. 3 is the configuration of conventional configurations and a right side in FIG. 3 is that of the present invention. In addition, FIG. 4 is an explanatory view showing a state in which the idle shaft 89 is mounted on the gear cover 24 (the idle gear assembly 97 is omitted to clearly show a mounting structure of the idle shaft 89).

As clearly seen from a plan view shown on a top part of the right figure of FIG. 3(*a*), the positioning groove 108 (center line $O_2$) and the screw insertion hole 104 (center line $O_1$) are formed at positions shifted for only an angle $\theta_1$ (60° here) with a center axis line $O_S$ of the idle shaft 89. Here, the screw mounting hole 106 is located at a position of 30° ($O_2$) with respect to an engine mounting surface 111 (Y) of the gear cover 24. Therefore, when the idle shaft 89 is mounted on the gear cover 24, and the positioning groove 108 is arranged in the right angle ($\theta_3$) with respect to the engine mounting surface 111 as shown in FIG. 4, the screw mounting hole 106 and the screw insertion hole 104 just face each other ($\theta_3=\theta_1+\theta_2$; 90°=60°+30°).

In addition, as understood from a plan view shown in a bottom part of the right figure of FIG. 3(*b*), a notched surface (positioning surface) 112 of the dustproof cap 103 is formed at a position of 90° ($\theta_4$) with respect to the fitting protrusion 109. Accordingly, when the dustproof cap 103 is mounted on the idle shaft 89 in a manner that the fitting protrusion 109 is fitted with the positioning groove 108, the notched surface 112 of the dustproof cap 103 is flush with the engine mounting surface 111 ($\theta_4=\theta_3$).

Now, the starting operation of an engine using such an electric starter motor 1 will be described. First, as shown in FIG. 1, when the ignition key switch of a car is turned OFF, the clutch outer 56 contacts the clutch stopper 67 by the pushing force of the gear return spring 65. At this time, the switch plate 43 is spaced from the conductive plate 41, supplying no current to the motor 11. Further, the idle gear 15 is in the disengagement position on the right and is disengaged from the ring gear 16. On the other hand, as shown in FIG. 4, when the ignition key switch is turned ON, the idle gear 15 moves to the left, engaging with the ring gear 16.

That is, when the ignition key switch is turned ON, current flows first to the coil 81, creating suction at the magnet switch section 4. When the coil 81 is excited, a magnetic path extending through the case 79 and the stationary iron core 82 is formed, sucking the movable iron core 83 to the left. When the movable iron core 83 moves to the left against the pushing force of the switch return spring 90, the switch shaft 45 moves also to the left, bringing the switch plate 43 into contact with the conductive plate 41 to close a contact. Thereby, an electric connection is made between the power source terminal 44 and the brush 39, supplying power to the commutator 35 to start the motor 11 and rotate the armature 22. In addition, the bracket plate 85 moves also to the left, thereby compressing the plunger spring 86.

When the armature 22 is rotated, the drive shaft 32 is rotated via the planetary gear mechanism 12. The rotations of the drive shaft 32 are accompanied by the rotations of the clutch outer 56 mounted to the helical spline section 61. The twisting direction of the helical spline section 61 is set in consideration of the rotation direction of the drive shaft 32. As the clutch outer 56 rotates faster, the clutch outer 56 moves to the left along the helical spline section 61 (rest position→operation position) due to the inertial mass thereof. When the clutch outer 56 protrudes to the left, the pinion 14 also moves to the left together with the clutch outer 56. At this time, the gear return spring 65 is also compressed by being pushed by the clutch outer 56.

When the clutch outer 56 moves to the left, the idle gear 15 also moves to the left by being pushed by the clutch outer 56, engaging with the ring gear 16. When the idle gear 15 engages with the ring gear 16, the rotations of the motor 11 are transmitted to the ring gear 16, rotating the ring gear 16. The ring gear 16 is connected to a crankshaft of the engine. The rotations of the ring gear 16 are accompanied by the rotations of the crankshaft, starting the engine. When the engine is started, the pinion 14 is rotated with a high rotation speed by the ring gear 16 via the idle gear 15. However, the rotations thereof are not transmitted to the motor 11 side by the action of the overrunning clutch 13.

In addition, when the engine is started and the idle gear 15 rotates at a high speed, a difference in the numbers of revolutions due to an overrunning condition is generated between the clutch cover 68 and the idle gear 15 and the pinion 14. By the difference in the numbers of revolutions, the collar 95 interposed between the clutch cover 68 and the idle gear 15 slides and contacts with the clutch cover 68 and the idle gear 15. At that time, since the collar 95 is formed with synthetic resin and grease is applied thereon, ablation of the clutch cover 68, and seizing of each member hardly occurs.

Further, when the clutch outer 56 moves to the left, the gear plunger 84 moves to the left by the pushing force of the compressed plunger spring 86, and then contacts with the right end surface of the clutch outer 56. At this time, the plunger spring 86 goes into a natural length state, creating a small gap between the gear plunger 84 contacting with the clutch outer 56 and the plunger spring 86.

When the engine is started, the pinion 14 is rotated with a high rotation speed, and the overrunning clutch 13 is rotated in an idle running direction. When the overrunning clutch 13 is rotated in the idle running direction, idle running torque is created in the clutch, applying torque called cutting torque to the clutch outer 56. This torque creates rightward thrust force in the clutch outer 56 via the helical spline section 61, moving the clutch outer 56 to the right. As a result, the idle gear 15 may be disengaged from the ring gear 16. Thus, in the electric starter motor 1, the clutch outer 56 is held by the gear plunger 84 in the operated position, regulating the rightward movement of the idle gear 15 to prevent the idle gear 15 from being disengaged.

On the other hand, when the ignition key switch is turned OFF after the engine has been started, the power distribution to the magnet switch section 4 is stopped, and the suction thereof disappears. Then, the bracket plate 85 is pushed by the pushing force of a switch return spring 90 to the right, moving the movable iron core 83 held on the left by the suction of the stationary iron core 82 to the right. When the movable iron core 83 moves to the right, the switch shaft 45 also moves to the right, separating the switch plate 43 from the conductive plate 41 to open the contact. Thereby, the power supply to the motor 11 is shut off, stopping the rotations of the drive shaft 32 to also stop the rotations of the clutch outer 56.

When the rotations of the clutch outer 56 are stopped, the axial moving force due to the inertial mass thereof also disappears. Thus, by the pushing force of the compressed gear return spring 65, the clutch outer 56 moves to the right from the operated position to the rest position along the helical spline section 61. At this time, the gear plunger 84 is also pushed by the clutch outer 56 and returns to the state of FIG. 1. In addition, the pushing force of the gear return spring 65 is set to be greater than that of the plunger spring 86 at that time.

When the clutch outer 56 moves to the right, the pinion 14 also moves to the right. When the pinion 14 moves to the right, the pinion washer 72 contacts with a left end surface of the idle gear 15. In this manner, the idle gear 15 moves to the right by the pinion washer 72, and the idle gear 15 is separated from the ring gear 16.

On the other hand, in the starter motor 1 including the above configuration, the idle shaft 89 is assembled in the following manner. FIG. 5 is an explanatory view showing a step of assembling and fixing the idle shaft 89 on the gear cover 24, and FIG. 6 is a process chart showing a main assembling step in such a case. As shown in FIG. 5, in the starter motor 1, the idle gear assembly 97 including the idle gear 15 is firstly allocated in an idle gear mounting section 100 of the gear cover 24. In this state, from a top side of the gear cover 24 in FIG. 5, the idle shaft 89 is inserted through the axis opening 101 formed on the bearing section 98. At this time, the idle shaft 89 is inserted in the axis opening 101 in a manner that the positioning groove (positioning part) 108 of the idle shaft 89 is oriented at a right angle (90°) with respect to the engine mounting surface 111 (step (1) of FIG. 6(*a*)). In this manner, the idle shaft 89 is mounted on the gear cover 24 so that the screw mounting hole 106 and the screw insertion hole 104 just facing-face each other.

Next, the idle shaft 89 is inserted though the idle gear assembly 97, and thereafter, inserted into the axis hole 102 formed on the bearing section 99. As described above, at that time, the screw mounting hole 106 and the screw insertion hole 104 are aligned with each other by disposing the positioning groove 108 and the engine mounting surface 111 in right angle relation. For this reason, the fixing screw 107 can be inserted from the screw mounting hole 106 without checking positions of the holes, and the fixing screw 107 can be screwed into the female screw section 105 through the screw insertion hole 104 (step (2) of FIG. 6(*a*)). In the above manner, after the idle shaft 89 is fixed on the gear cover 24, the dustproof cap 103 is mounted (step (3) of FIG. 6(*a*)). The dustproof cap 103 is mounted on the idle shaft 89 in a manner such that the fitting protrusion 109 of the dustproof cap 103 is fitted with the positioning groove 108. At this time, the notched surface 112 of the dustproof cap 103 is flush with the engine mounting surface 111.

As described above, in the starter motor 1 according to the present invention, the positioning groove 108 indicating a position of the screw insertion hole 104 is provided on an upper end surface of the idle shaft 89. Therefore, by adjusting a rotational position of the idle shaft 89 so as to mount the positioning groove 108 in a predetermined direction (right angle with respect to the engine mounting surface 111 in the present embodiment), the idle shaft 89 can be mounted on the gear cover 24 in a manner such that the screw mounting hole 106 and the screw insertion hole 104 just face each other. That is, before the idle shaft 89 is inserted, a screw hole for fixing the idle shaft can be positioned. For this reason, without checking whether the screw mounting hole 106 and the screw insertion hole 104 match with each other or not, the fixing screw 107 can be inserted from the screw mounting hole 106, and checking of positions of the holes and alignment of the holes become unnecessary in subsequent steps. Accordingly, workability in an assembly step is improved and reduction in the number of steps is attempted, and thereby a manufacturing cost can be reduced.

In addition, since alignment of the holes is not necessary, the adjustment of poor workability carried out by holding the P part in FIG. 9 is not necessary as well. For this reason, the worker does not touch the part to which the grease is applied. In this manner, quality of product is improved, and hands of the worker are not stained as well as the working environment is improved. Further, whether the holes are matched or not need not be checked, and insertion and screwing of the idle shaft 89 are easily carried out in the automated line. In this manner, assembly of the starter motor 1 can be automated.

On the other hand, the screw mounting hole 106 and the screw insertion hole 104 can be aligned by using the dustproof cap 103. That is, when the dustproof cap 103 is mounted on the idle shaft 89 and the notched surface 112 of the idle shaft 89 is made flush with the engine mounting surface 111, the idle shaft 89 can be inserted in a manner such that both of the holes face each other. Therefore, an assembling step of the idle shaft 89 can be carried out in a manner shown in FIG. 6(*b*). Here, the idle shaft 89 is inserted in the axis opening 101 and the axis hole 102 in a state where the dustproof cap 103 is mounted on the idle shaft 89, and at that time, the notched surface 112 is made flush with the engine mounting surface 111 (FIG. 6(*b*), step (1)). In this manner, the idle shaft 89 is mounted on the gear cover 24 so that the screw mounting hole 106 and the screw insertion hole 104 just face each other.

Then, the idle shaft 89 is inserted through the idle gear assembly 97, and thereafter the idle shaft 89 is inserted to the axis hole 102 formed in the bearing section 99. At this time, the screw mounting hole 106 and the screw insertion hole 104 match with each other. Therefore, without checking the positions of the holes, the fixing screw 107 can be inserted into the screw mounting hole 106, and then the fixing screw 107 can be screwed into the female screw section 105 through the screw insertion hole 104 (FIG. 6(*b*), step (2)). As described above, when the dustproof cap 103 is mounted on the idle shaft 89 in advance and the idle shaft 89 is assembled by using the dustproof cap 103 as an indicator for positioning, the assembly step can be further simplified as shown in FIG. 6(*b*). The idle shaft 89 may be inserted into the axis opening 101 and the axis hole 102 without specifically carrying out alignment, and then the dustproof cap 103 may be mounted, and at this time, the dustproof cap 103 may be appropriately rotated to align the positions of the holes.

Needless to say, the present invention is not limited to the above embodiment, and a variety of modifications can be made in a scope not deviating from the gist of the present invention.

In the embodiment described above, the screw mounting hole 106 and the screw insertion hole 104 are configured to just face each other by mounting the positioning groove 108 at a position in the right angle with respect to the engine mounting surface 111. However, the position of the positioning groove 108 is not limited to the right angle as long as the configuration is such that positioning can be easily carried out, and setting can be made appropriately, such as in a direction matching with the engine mounting surface 111 (in parallel position). For example, the positioning groove 108 may be provided in the same direction as the screw insertion hole 104, and an indication (arrow or the like) indicating a mounting position may be provided on the gear cover 24 or an upper end surface of the bearing section 98 in FIG. 5. In addition, the indication of the positions of the holes is not limited to a groove, and may be a protrusion or a notch, or may be indicated by an arrow which is labeled or painted, as long as the indication is easily visually recognized by the worker. Further, in order to effect the positioning of the idle shaft 89, convexo-concave fitting parts may be provided on the axis opening 101 and the idle shaft 89.

In addition, in the embodiment described above, the configuration in which the fixing screw 107 is used as the idle shaft fixing member is shown. However, a fixing material other than a screw, such as a pin, can be used as well. Further, in the embodiment described above, the starter motor in which the overrunning clutch 13 is mounted on the drive shaft 32 rotated by the motor 11 via the planetary gear mechanism 12 is shown. However, there is no specific limitation with respect to the form of the starter motor. The present invention may be applied to starter motors of a variety of forms, including a starter motor in which an overrunning clutch is mounted on a front end part of the motor shaft 27.

The invention claimed is:

1. A starter motor comprising:

an idle gear to be rotationally driven by a motor, said idle gear configured to be movable in an axial direction so to mesh with a ring gear of an engine;

an idle shaft supporting said idle gear such that said idle gear is freely rotated and movable in the axial direction, said idle shaft having an insertion hole;

a cover member to be mounted on the engine, said cover member supporting both end parts of said idle shaft and having a mounting hole; and a shaft fixing member inserted through said mounting hole in said cover member and into said insertion hole in said idle shaft in a state in which said mounting hole faces said insertion hole and such that said shaft fixing member fixes said idle shaft to said cover member;

wherein said idle shaft has a positioning part located at a predetermined position with respect to said insertion hole, said positioning part being arranged and oriented so as to indicate a proper rotational adjustment of a position of said idle shaft about a longitudinal axis of said idle shaft such that said mounting hole and said insertion hole face each other so that said shaft fixing member can be inserted into said insertion hole through said mounting hole.

2. The starter motor according to claim 1, wherein said positioning part is provided on an end surface of said idle shaft.

3. The starter motor according to claim 2, wherein said cover member has an engine mounting surface, said positioning part being provided in a predetermined positional relationship with respect to said engine mounting surface to allow said idle shaft to be positioned such that said mounting hole and said insertion hole face each other.

4. The starter motor according to claim 1, wherein said cover member has an engine mounting surface, said positioning part being provided in a predetermined positional relationship with respect to said engine mounting surface to allow said idle shaft to be positioned such that said mounting hole and said insertion hole face each other.

5. The starter motor according to claim 4, wherein said positioning part is arranged at a right angle position with respect to said engine mounting surface of said cover member to allow said idle shaft to be positioned such that said mounting hole and said insertion hole face each other.

6. The starter motor according to claim 1, further comprising a cap member mounted on an end of said idle shaft, said cap member including a junction section connected with said positioning part in a predetermined positional relationship.

7. The starter motor according to claim 6, wherein said cover member has an engine mounting surface, said cap member having a positioning surface flush with said engine mounting surface of said cover member when said cap member is mounted on said positioning part via said junction section.

8. The starter motor according to claim 1, wherein said cover member further has a female screw part formed on a longitudinal axis of said mounting hole such that said female screw part and said mounting hole are coaxial, said idle shaft having been inserted through said mounting hole and into said insertion hole being further threaded into said female screw part.

9. A starter motor comprising:

an idle gear to be rotationally driven by a motor, said idle gear configured to be movable in an axial direction so to mesh with a ring gear of an engine;

an idle shaft supporting said idle gear such that said idle gear is freely rotated and movable in the axial direction, said idle shaft having an insertion hole;

a cover member to be mounted on the engine, said cover member supporting both end parts of said idle shaft and having a mounting hole; and a shaft fixing member inserted through said mounting hole in said cover member and into said insertion hole in said idle shaft in a state in which said mounting hole faces said insertion hole and such that said shaft fixing member fixes said idle shaft to said cover member;

wherein said idle shaft has a positioning part located at a predetermined position with respect to said insertion hole so as to allow said idle shaft to be positioned such that said mounting hole and said insertion hole face each other so that said shaft fixing member can be inserted into said insertion hole through said mounting hole;

wherein said positioning part is a groove or a protrusion on an end surface of said idle shaft so as to extend in a radial direction of said idle shaft, said positioning part being oriented so as to be rotated a predetermined angle in a circumferential direction from a position of said insertion hole with respect to a center axis line of said idle shaft.

10. The starter motor according to claim 9, wherein said cover member further has a female screw part formed on a longitudinal axis of said mounting hole such that said female screw part and said mounting hole are coaxial, said idle shaft having been inserted through said mounting hole and into said insertion hole being further threaded into said female screw part.

11. A starter motor comprising:

an idle gear to be rotationally driven by a motor, said idle gear configured to be movable in an axial direction so to mesh with a ring gear of an engine;

an idle shaft supporting said idle gear such that said idle gear is freely rotated and movable in the axial direction, said idle shaft having an insertion hole;

a cover member to be mounted on the engine, said cover member supporting both end parts of said idle shaft and having a mounting hole;

a shaft fixing member inserted through said mounting hole in said cover member and into said insertion hole in said idle shaft in a state in which said mounting hole faces said insertion hole and such that said shaft fixing member fixes said idle shaft to said cover member, wherein said idle shaft has a positioning part located at a predetermined position with respect to said insertion hole so as to allow said idle shaft to be positioned such that said mounting hole and said insertion hole face each other so that said shaft fixing member can be inserted into said insertion hole through said mounting hole; and a cap member mounted on an end of said idle shaft, said cap member including a junction section connected with said positioning part in a predetermined positional relationship;

wherein said cover member has an engine mounting surface, said cap member having a positioning surface flush with said engine mounting surface of said cover member when said cap member is mounted on said positioning part via said junction section; and wherein said positioning surface is configured so that said mounting hole and said insertion hole face each other when said positioning surface is flush with said engine mounting surface.

12. The starter motor according to claim 11, wherein said cover member further has a female screw part formed on a longitudinal axis of said mounting hole such that said female screw part and said mounting hole are coaxial, said idle shaft having been inserted through said mounting hole and into said insertion hole being further threaded into said female screw part.

* * * * *